US006860575B2

(12) United States Patent
Chen et al.

(10) Patent No.: US 6,860,575 B2
(45) Date of Patent: Mar. 1, 2005

(54) SAFETY DEVICE FOR A SLIDE TRACK RETAINER

(75) Inventors: Ken-Ching Chen, Kaohsiung Hsien (TW); Shih-Long Hwang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/411,315

(22) Filed: Apr. 11, 2003

(65) Prior Publication Data

US 2004/0201340 A1 Oct. 14, 2004

(51) Int. Cl.[7] ..... A47B 88/00
(52) U.S. Cl. ..... 312/334.46; 312/334.44
(58) Field of Search ..... 312/330.1, 334.1, 312/334.7, 334.11, 334.17, 334.44, 334.46, 334.47

(56) References Cited

U.S. PATENT DOCUMENTS 6,126,255 A * 10/2000 Yang ..... 312/334.46
6,220,683 B1 * 4/2001 Chu ..... 312/334.44
6,224,177 B1 * 5/2001 Chu ..... 312/334.1
6,390,575 B1 * 5/2002 Chen et al. ..... 312/334.46
6,585,335 B2 * 7/2003 Hwang et al. ..... 312/333
6,705,689 B2 * 3/2004 Chen et al. ..... 312/334.46

* cited by examiner

*Primary Examiner*—Peter M. Cuomo
*Assistant Examiner*—Stephen Vu
(74) *Attorney, Agent, or Firm*—Bacon & Thomas PLLC

(57) ABSTRACT

A slide track assembly includes an outer slide track, a medium slide track, an inner slide track and a retainer. The outer slide track includes a protrusion. The medium slide track is adapted to mount the retainer which includes an elastic plate, a safety protrusion and an unlatching member. When the inner slide track is initially retracted into the medium slide track, an end of the inner slide track is engaged with the safety protrusion of the retaining member. Thereby, a temporary safety space is formed between the inner slide track and the medium slide track such that the user's fingers are able to be removed from the inner slide track. Before the inner slide track is completely retracted into the medium slide track, the protrusion of the outer slide track may push the unlatching member to disengage the safety protrusion from the end of the inner slide track.

9 Claims, 9 Drawing Sheets

SAFETY DEVICE FOR A SLIDE TRACK RETAINER

BACKGROUND OF THE INVENTION

1. Field of the Invention

The present invention is related to a safety device for a slide track retainer. More particularly, the present invention is related to a retainer mounted to a medium slide track, thereby providing with a temporary safety space of slide tracks for avoiding injuries of fingers by accident.

2. Description of the Related Art

Referring to FIG. 1, a conventional three-section slide track for a drawer includes an outer slide track 10, a medium slide track 20 and an inner slide track 30. A ball track 40 is sandwiched in between any two of the outer slide track 10, the medium slide track 20 and the inner slide track 30 so as to smoothen sliding movement. Moreover, the medium slide track 20 and the inner slide track 30 mount a stop member 201 and a retaining member 301 respectively for retaining purpose. The retaining member 301 is mounted to a rear end of the inner slide track 30, and provided with an engaging portion 302. The stop member 201 is mounted to a front end of the medium slide track 20, and provided with a protrusion 202. To prevent taking apart by accident, when users draws out the inner slide track 30 from the medium slide track 20, the protrusion 202 of the stop member 201 is engaged with the engaging portion 302 of the retaining member 301 in place.

Users can draw out a keyboard or a component, which is attached to the first slide track 30, for service. Although the engagement of the stop member 201 with the engaging portion 302 can avoid releasing the inner slide track 30 from the medium slide track 20 by accident, it cannot prevent the inner slide track 30 from pulling fingers into the medium slide track 20 when retracted.

The present invention intends to provide a slide track retainer with a safety device, which comprises an elastic plate, a safety protrusion and an unlatching member. The present invention is provided with a temporary safety space formed between two ends of the slide tracks by a retainer when an inner slide track is initially retracted into a medium slide track. Thereby, before the inner slide track is completely retracted into the outer slide track, fingers are able to remove from the slide tracks in time in such a way to mitigate and overcome the above problem.

SUMMARY OF THE INVENTION

The primary objective of this invention is to provide a safety device for a slide track retainer, which comprises a retainer mounted to a medium slide track. A temporary safety space is formed between an end of an inner slide track and an end of a medium slide track by the retainer when the inner slide track is initially retracted into the medium slide track. Thereby, fingers are able to remove from the slide tracks in time before the inner slide track is completely retracted into the medium slide track.

The slide track assembly in accordance with the present invention comprises an outer slide track, a medium slide track, an inner slide track and a retainer. The outer slide track includes a protrusion; the medium slide track is adapted to mount the retainer which includes an elastic plate, a safety protrusion and an unlatching member. When the inner slide track is initially retracted into the medium slide track, an end of the inner slide track is engaged with the safety protrusion of the retaining member. Thereby, a temporary safety space is formed between an end of the inner slide track and an end of the medium slide track such that fingers are able to remove from the inner slide track in time. Before the inner slide track is completely retracted into the medium slide track, the protrusion of the outer slide track may push the unlatching member to disengage the safety protrusion from the end of the inner slide track.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
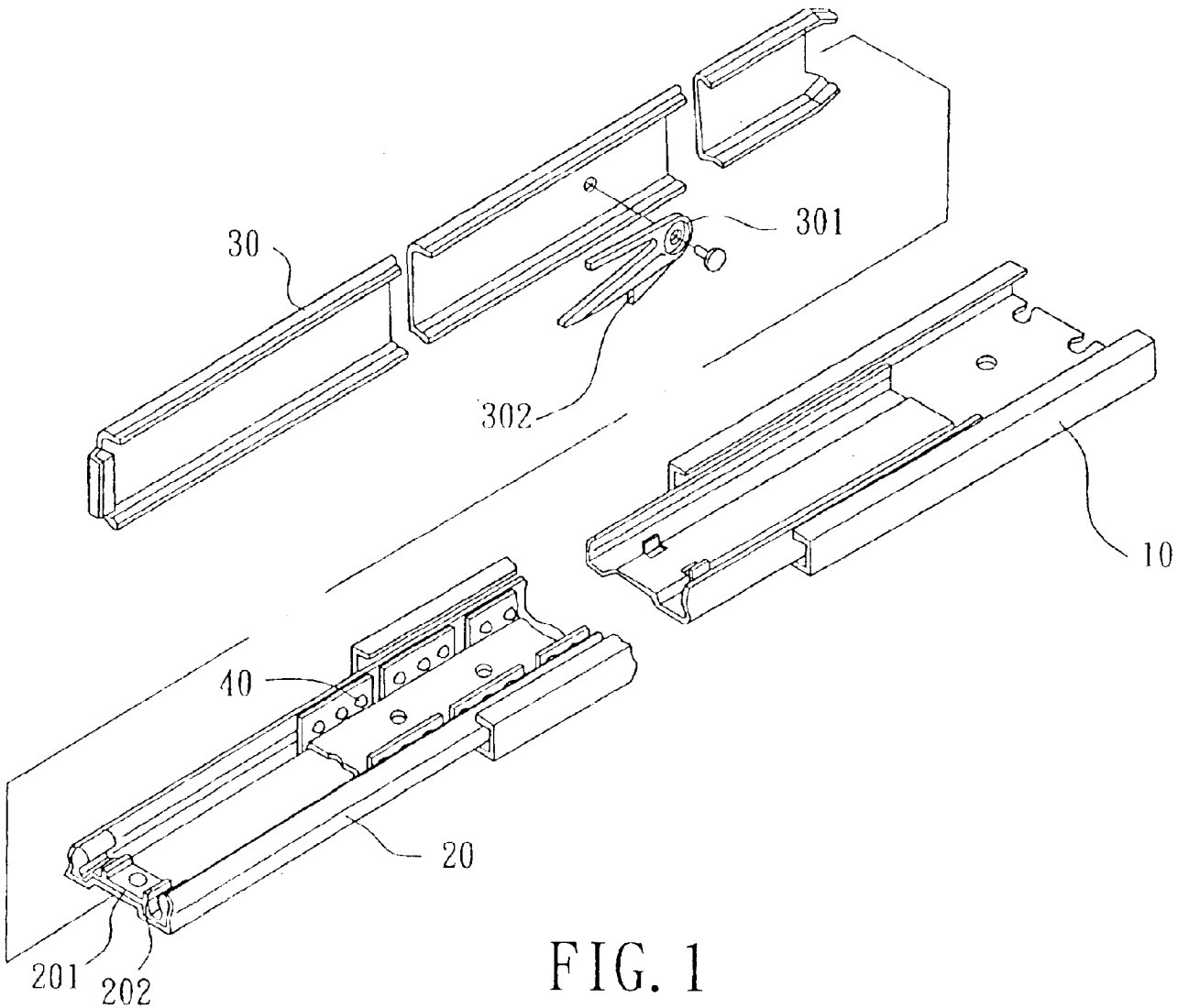
FIG. 1 PRIOR ART
FIG. 1 is an exploded perspective view of a conventional three-section slide track in accordance with the prior art.

Referring to FIGS. 2 through 9, reference numerals of the embodiments have applied the identical numerals of the conventional slide track assembly. The slide track assembly of the embodiment has the similar configuration and same function as the conventional slide track assembly and the detailed descriptions are omitted.

Referring to FIGS. 2 through 5, a slide track assembly in accordance with the first embodiment of the present invention comprises an outer slide track 10, a medium slide track 20, an inner slide track 30 and a retainer 50. The outer slide track 10 includes a protrusion 11; the medium slide track 20 is adapted to mount the retainer 50 which includes an elastic plate 52, a safety protrusion 53 and an unlatching member 54. When the inner slide track 30 is initially retracted into the medium slide track 20, an end of the inner slide track 30 is engaged with the safety protrusion 53 of the retaining member 50. Thereby, a temporary safety space is formed between an end of the inner slide track 30 and an end of the medium slide track 20 such that fingers are able to remove from the inner slide track 30 in time. Before the inner slide track 30 is completely retracted into the medium slide track 20, the protrusion 11 of the outer slide track 10 may push the unlatching member 54 to disengage the safety protrusion 53 from the end of the inner slide track 30.

Construction of the retainer 50 shall be described in detail, referring again to FIGS. 2 and 3. The retainer 50 is preferably applied to various specifications of drawers, such as a three-section slide track, and made of soft metal, steel or alloy. In the manufacture, the retainer 50 is stamped and comprised of a through hole 51, an elastic plate 52, a safety protrusion 53 and an unlatching member 54. The retainer 50 is attached to the medium slide track 20 and the through hole 51 is aligned with a through hole 21 of the medium slide track 20 via attachment 511. The elastic plate 52 is bent from a top edge of the retainer 50 to its first side and extended to the longitudinal direction of the medium slide track 20. In assembling operation, an end of the elastic plate 52 is in contact with a tooth 22 of the medium slide track 20, thereby turning and returning the elastic plate 52. The safety protrusion 53 is bent to its first side and extended from the top edge of the retainer 50 proximal a front end of the medium slide track 20. The unlatching member 54 is bent to its second side and extended with an extension 541 from a bottom edge of the retainer 50. Preferably, the unlatching member 54 has an inclination with respect to the longitudinal direction of the medium slide track 20. The unlatching member 54 is extended through a slot 23 of the medium slide track 20 and engaged with the protrusion 11 of the outer slide track 10 after moving a predetermined distance. The slot 23 is provided with an inclined edge (a) corresponding to the inclination of the unlatching member 54. Moreover, the safety protrusion 53 of the retainer 50 is located at a distance D1 from the front end of the medium slide track 20 after assembly.

Referring again to FIG. 3, when the medium slide track 20 and the inner slide track 30 are drawn out from the outer slide track 10, the elastic plate 52 is in elastic contact with the tooth 22 of the medium slide track 20 so that the unlatching member 54 may rest on the inclined edge (a) of the slot 23. Then, the safety protrusion 53 is located at a position with which to engage with an end of the inner slide track 30.

Figure 2:
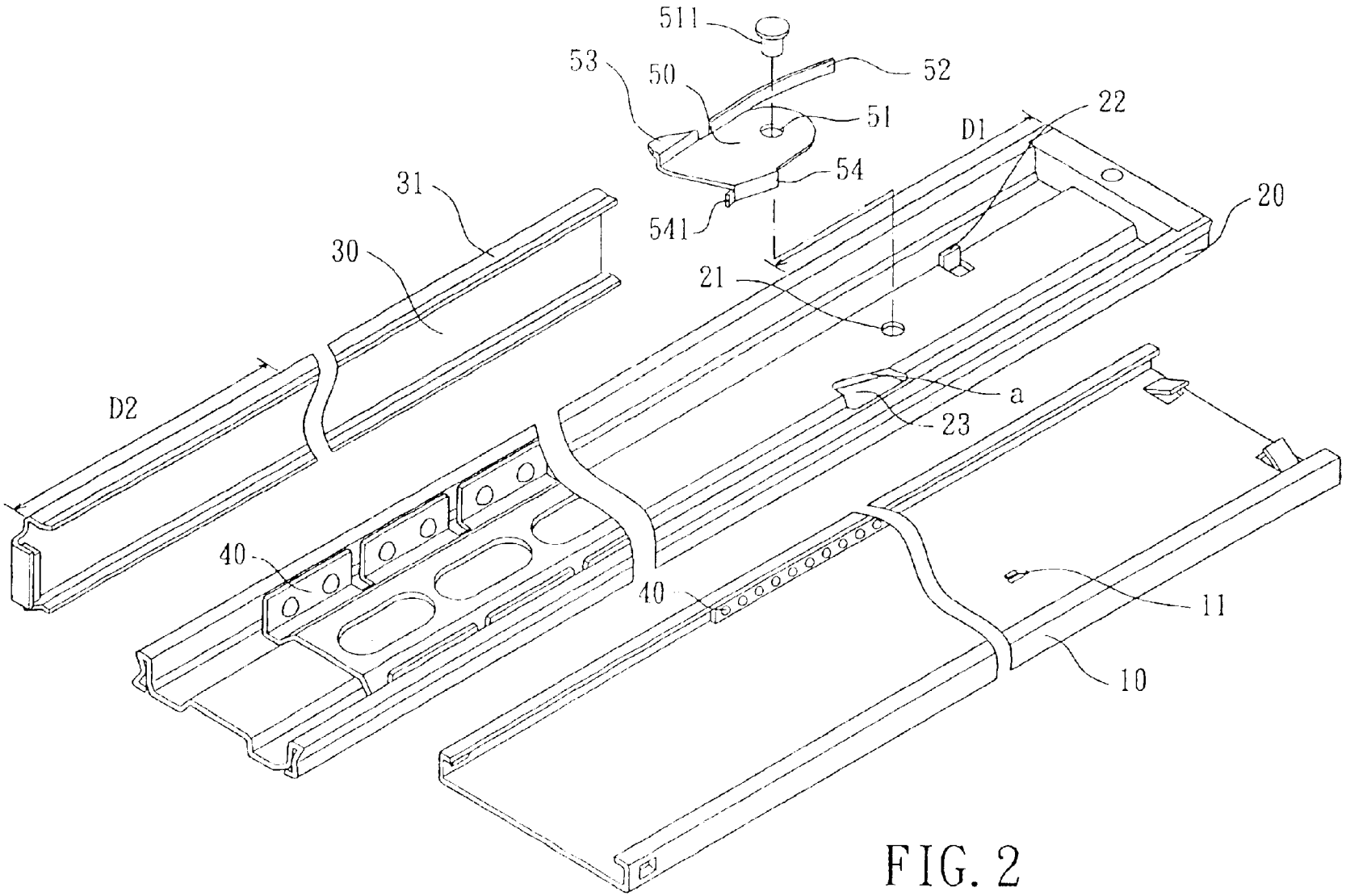
FIG. 2 is an exploded perspective view of a safety device of a slide track retainer in accordance with a first embodiment of the present invention.
Figure 3:
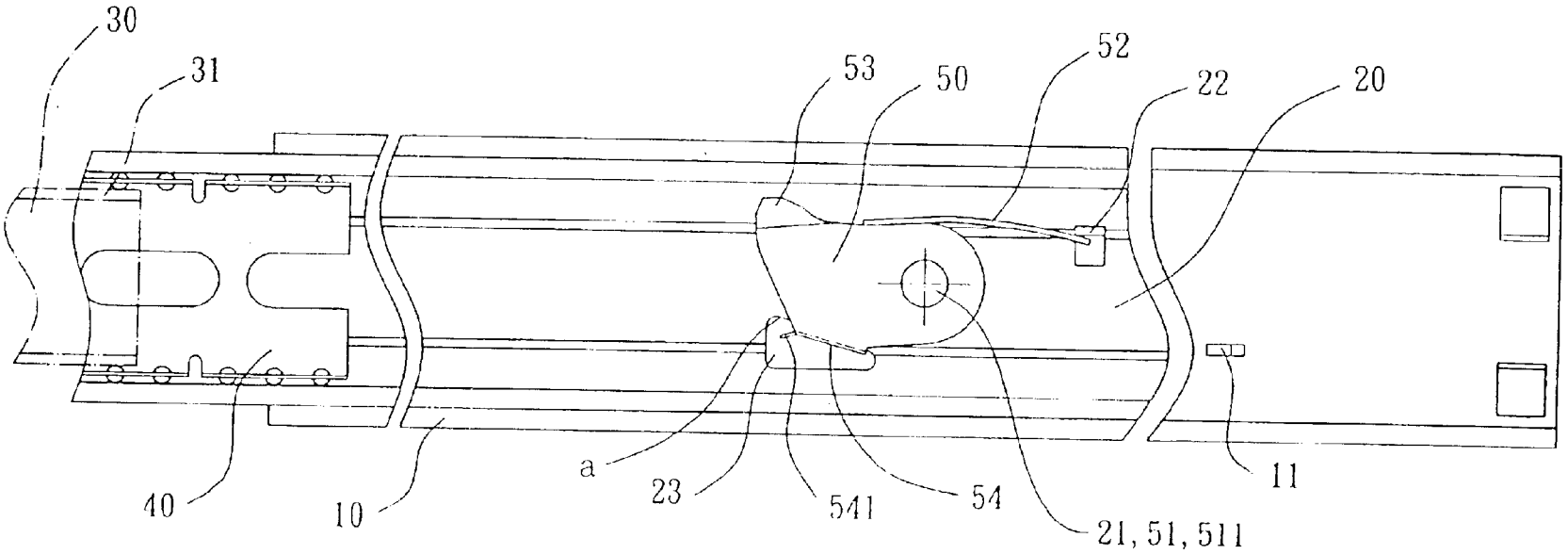
FIG. 3 is a lateral view of the safety device of the slide track retainer in accordance with the first embodiment of the present invention.
Figure 4:
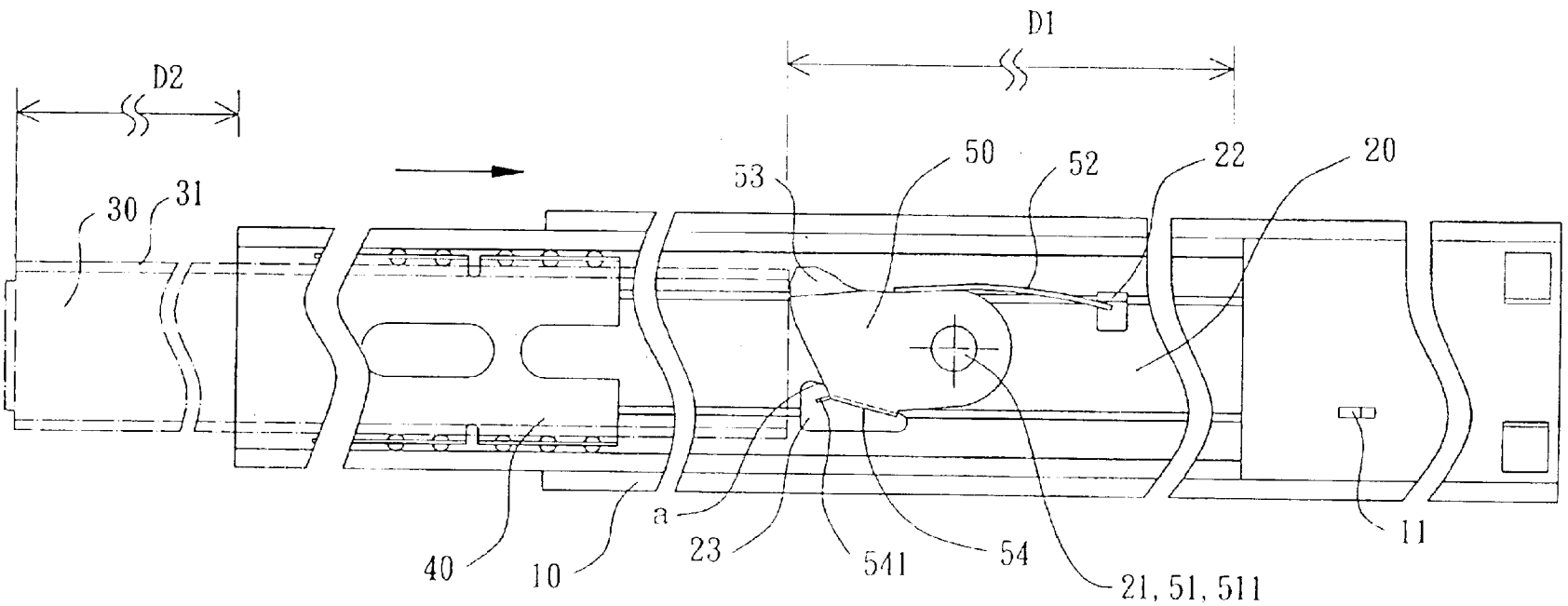
FIG. 4 is a lateral view of the safety device of the slide track retainer in accordance with the first embodiment of the present invention formed with a safety space between an inner slide track and a medium slide track.
Figure 5:
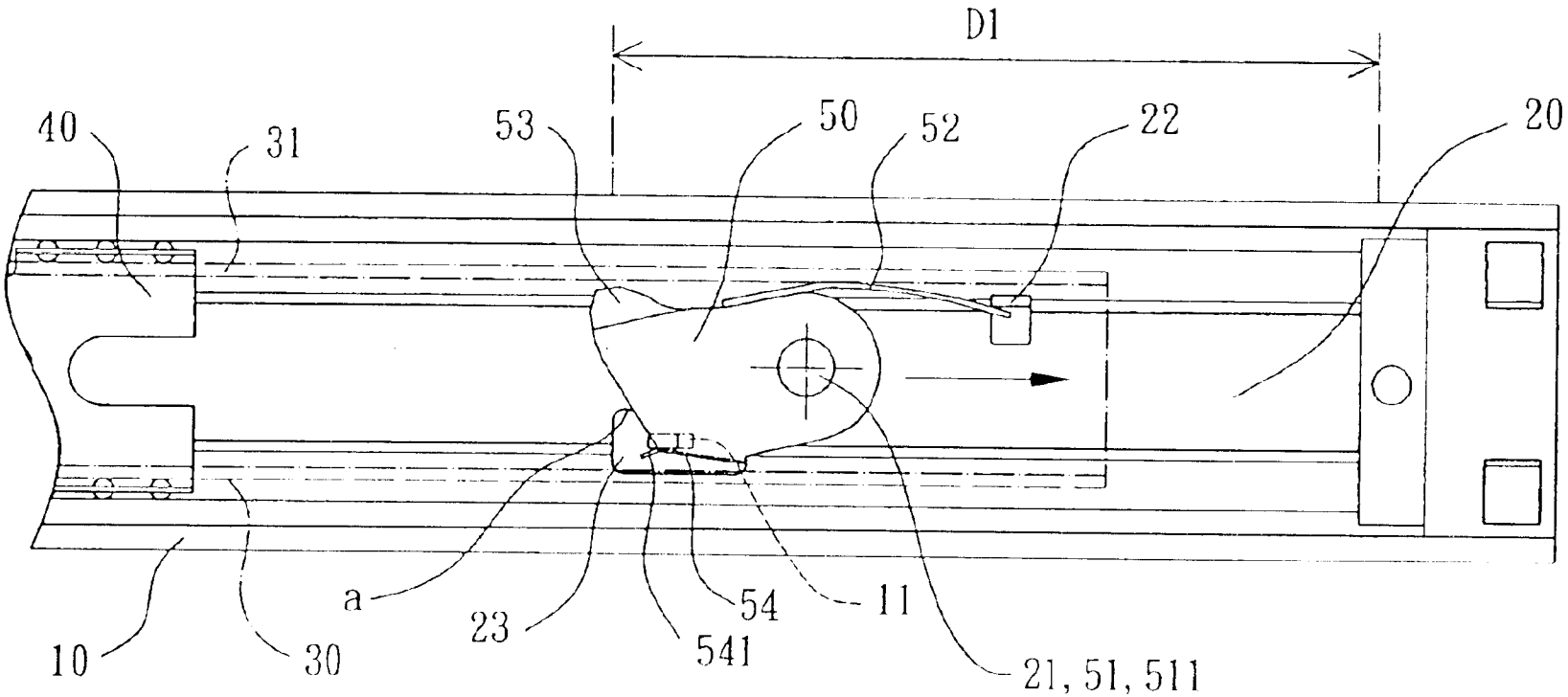
FIG. 5 is a lateral view of the safety device of the slide track retainer in accordance with the first embodiment of the present invention functioned in unlatching operation.

Referring again to FIG. 4, the inner slide track 30 is pushed and retracted into the medium slide track 20 until an end of an upper flange 31 of the inner slide track 30 is engaged with the safety protrusion 53 of the retainer 50. Meanwhile, a distance D1 is remained between the two rear ends of the medium slide track 20 and the inner slide track 30 so that a safety distance D2 is formed between the two front ends, as best shown in FIG. 2. Thereby, fingers are able to remove from the safety distance D2 of the slide tracks in time to avoid pulling into the slide track assembly. Moreover, other control mechanisms (not shown) are preferably arranged in the safety distance D2 formed between the inner slide track 30 and the medium slide track 20 that insures safety operation. And the control mechanisms are adapted to control relative movements among the outer slide track 10, the medium slide track 20, and the inner slide track 30.

Referring again to FIG. 5, after the inner slide track 30 is retracted into the medium slide track 20 a predetermined distance, the unlatching member 54 is engaged with the protrusion 11 of the outer slide track 10 and the safety protrusion 53 of the retainer 50 is turned an angular distance. Thus, the engaged relationship of the safety protrusion 53 with the upper flange 31 is disengaged so as to allow the inner slide track 30 to completely retract into the medium slide track 20. Once the unlatching member 54 is engaged with the protrusion 11 of the outer slide track 10, fingers must be removed from the inner slide track 30. Therefore, fingers are insured to avoid pulling into the slide track assembly by accident before the inner slide track 30 is completely retracted into the medium slide track 20.

The slide track assembly of the present invention is applied to various specifications of drawers, and improved by temporarily positioning the inner slide track 30 at a predetermined position of the medium slide track 20.

Preferably, the unlatching member 54 of the retainer 50 is extended forward to form a protrusion 541 adapted to allow the protrusion 11 of the outer slide track 10 smoothly passing through it.

Figure 6:
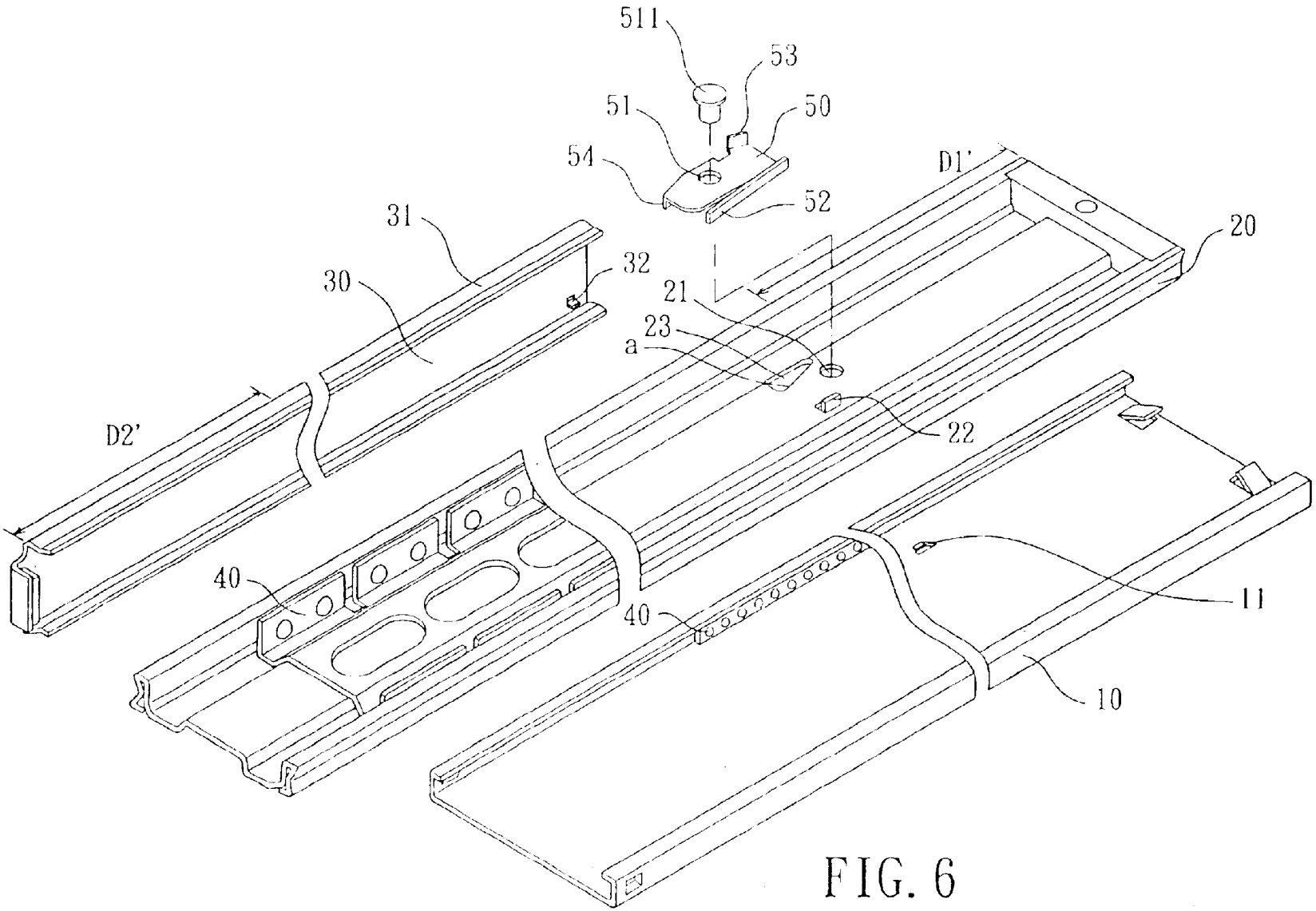
FIG. 6 is an exploded perspective view of a safety device of a slide track retainer in accordance with a second embodiment of the present invention.
Figure 7:
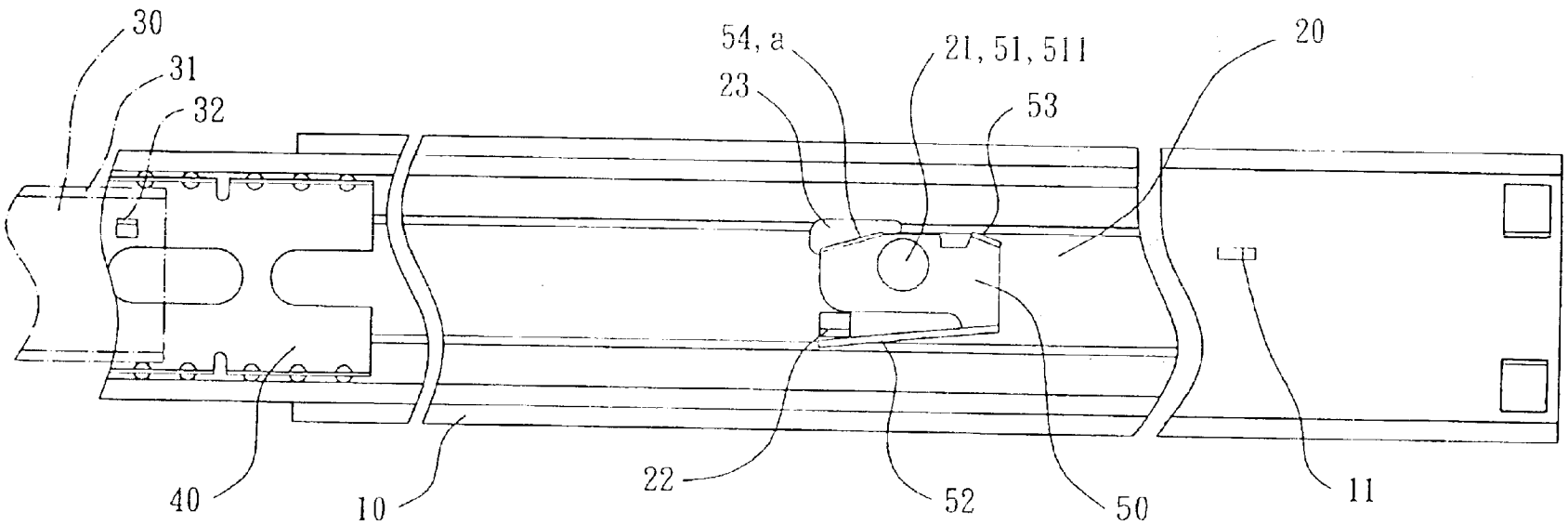
FIG. 7 is a lateral view of the safety device of the slide track retainer in accordance with the second embodiment of the present invention.

Referring to FIGS. 6 and 7, a slide track assembly in accordance with the second embodiment of the present invention comprises an outer slide track 10, a medium slide track 20, an inner slide track 30 and a retainer 50. The retainer 50 of the second embodiment of the present invention includes an elastic plate 52, a safety protrusion 53 and an unlatching member 54. In comparison with the first embodiment, the elastic plate 52 is bent from a bottom edge of the retainer 50 to its second side. The elastic plate 52 is adapted to contact with a tooth 22 which is located at a bottom of the medium slide track 20. The safety protrusion 53 is bent to its second side and extended from a top edge of the retainer 50 proximal a rear end of the medium slide track 20. Meanwhile, the inner slide track 30 further includes an engaging flange 32 adapted to engage with the safety protrusion 53. The unlatching member 54 is bent to its first side and extended from the top edge of the retainer 50. Preferably, the unlatching member 54 has an inclination with respect to the longitudinal direction of the medium slide track 20, and the slot 23 is also provided with an inclined edge (a) corresponding to the inclination of the unlatching member 54.

Figure 8:
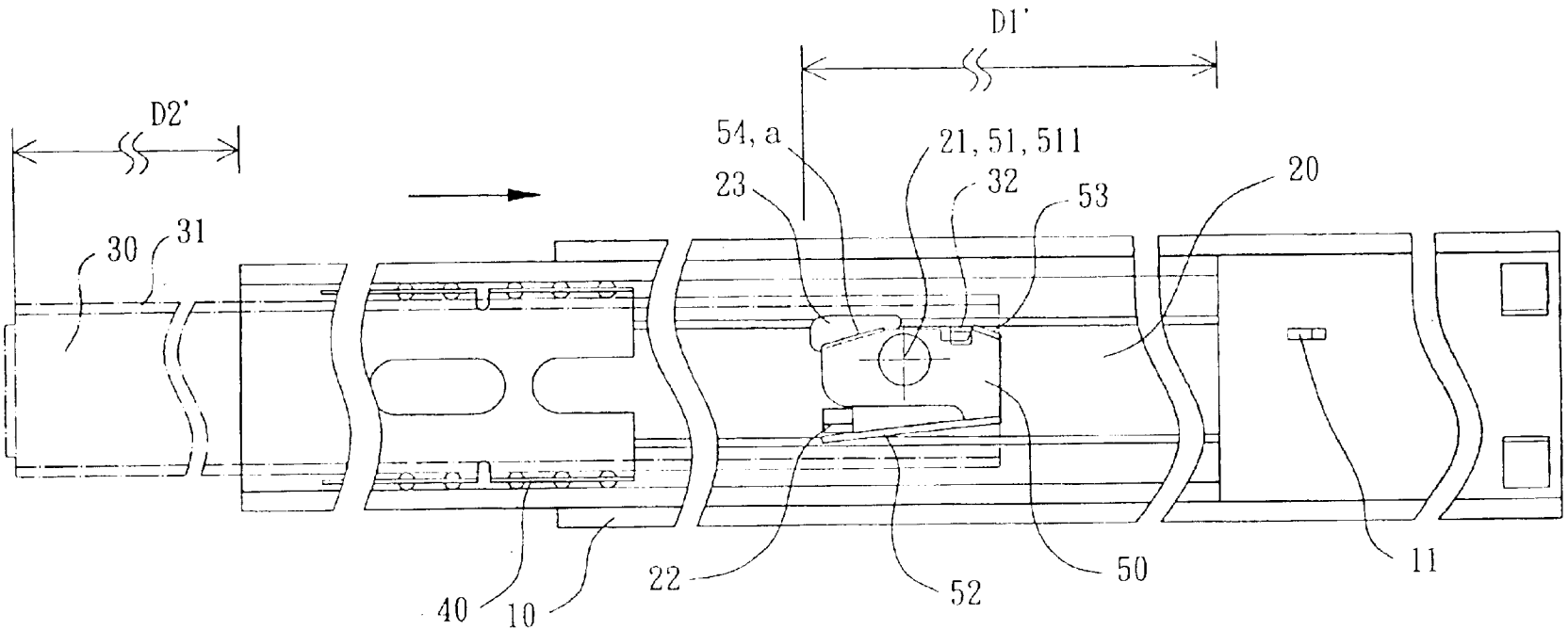
FIG. 8 is a lateral view of the safety device of the slide track retainer in accordance with the second embodiment of the present invention formed with a safety space between an inner slide track and a medium slide track.

Referring to FIG. 8, the inner slide track 30 is pushed and retracted into the medium slide track 20 until the engaging flange 32 of the inner slide track 30 is engaged with the safety protrusion 53 of the retainer 50. Meanwhile, a distance D1' is remained between the two rear ends of the medium slide track 20 and the inner slide track 30 so that a safety distance D2' is formed between the two front ends, as best shown in FIG. 6. Thereby, fingers are able to remove from the safety distance D2' of the slide tracks in time to avoid pulling into the slide track assembly.

Figure 9:
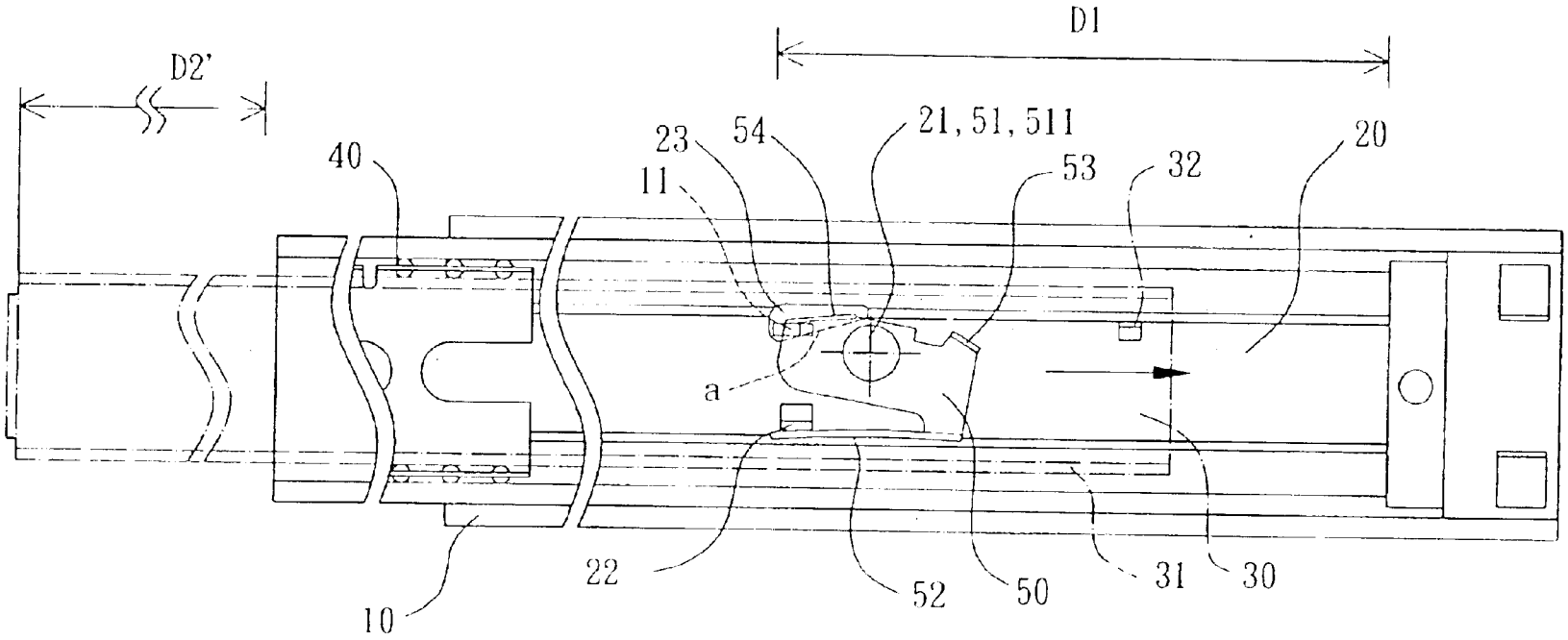
FIG. 9 is a lateral view of the safety device of the slide track retainer in accordance with the first embodiment of the present invention functioned in unlatching operation.

Referring to FIG. 9, after the inner slide track 30 is retracted into the medium slide track 20 a predetermined distance, the unlatching member 54 is engaged with the protrusion 11 of the outer slide track 10 and the safety protrusion 53 of the retainer 50 is turned an angular distance. Thus, the engaged relationship of the safety protrusion 53 with the engaging flange 32 is disengaged so as to allow the inner slide track 30 to completely retract into the medium slide track 20. Once the unlatching member 54 is engaged with the protrusion 11 of the outer slide track 10, fingers must be removed from the inner slide track 30. Therefore, fingers are insured to avoid pulling into the slide track assembly by accident before the inner slide track 30 is completely retracted into the medium slide track 20.

In a design choice, the elastic plates 52 described in the first and second embodiments are preferably substituted by springs (not shown) for reciprocation.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A slide track assembly, comprising:

an outer slide track provided with a protrusion;

a medium slide track being inserted into the outer slide track, and including a slot;

an inner slide track being inserted into the medium slide track;

a retainer pivotally mounted to the medium slide track, including an elastic plate, a safety protrusion and an unlatching member;

the elastic plate adapted to contact with the medium slide track;

the safety protrusion adapted to engage with the inner slide track to form a safety space between the inner slide track and the medium slide track during retracting operation of the inner slide track into the medium slide track; and the unlatching member adapted to extend through the slot of the medium slide track so as to be actuated by the protrusion of the outer slide track that the safety protrusion may disengage from the inner slide track and remove the safety space for further retracting the inner slide track into the medium slide track.

2. The slide track assembly as defined in claim 1, wherein the elastic plate and the safety protrusion are provided on a top edge of the retainer while the unlatching member is provided on a bottom edge of the retainer.

3. The slide track assembly as defined in claim 1, wherein the elastic plate and the safety protrusion are provided on a bottom edge of the retainer while the unlatching member providing on a top edge of the retainer.

4. The slide track assembly as defined in claim 1, wherein the unlatching member has an inclination with respect to the longitudinal direction of the medium slide track, and the slot of the medium slide track is also provided with an inclined edge corresponding to the inclination of the unlatching member.

5. The slide track assembly as defined in claim 1, wherein the unlatching member is extended forward to form a protrusion adapted to allow the protrusion of the outer slide track smoothly passing through it.

6. The slide track assembly as defined in claim 1, wherein the safety protrusion adapted to engage with an end of the inner slide track.

7. The slide track assembly as defined in claim 1, wherein the safety protrusion adapted to engage with an engaging flange of the inner slide track.

8. A slide track assembly, comprising:

an outer slide track provided with a protrusion;

a medium slide track being inserted into the outer slide track, and including a slot;

an inner slide track being inserted into the medium slide track;

a retainer pivotally mounted to the medium slide track, including an elastic plate, a safety protrusion and an unlatching member;

the elastic plate adapted to contact with the medium slide track; the safety protrusion adapted to engage with the inner slide track to form a safety space between the inner slide track and the medium slide track;

the unlatching member adapted to extend through the slot of the medium slide track so as to be actuated by the protrusion of the outer slide track that the safety protrusion may disengage from the inner slide track; and wherein the elastic plate and the safety protrusion are provided on a top edge of the retainer while the unlatching member is provided on a bottom edge of the retainer.

9. A slide track assembly, comprising:

an outer slide track provided with a protrusion;

a medium slide track being inserted into the outer slide track, and including a slot;

an inner slide track being inserted into the medium slide track;

a retainer pivotally mounted to the medium slide track, including an elastic plate, a safety protrusion and an unlatching member;

the elastic plate adapted to contact with the medium slide track;

the safety protrusion adapted to engage with the inner slide track to form a safety space between the inner slide track and the medium slide track; and the unlatching member adapted to extend through the slot of the medium slide track so as to be actuated by the protrusion of the outer slide track that the safety protrusion may disengage from the inner slide track; and wherein the unlatching member has an inclination with respect to the longitudinal direction of the medium slide track, and the slot of the medium slide track is also provided with an inclined edge corresponding to the inclination of the unlatching member.

* * * * *